United States Patent [19]

Yasuoka et al.

[11] Patent Number: 4,793,606

[45] Date of Patent: Dec. 27, 1988

[54] PAPER FEEDING DEVICE FOR A PRINTER

[75] Inventors: Tadashi Yasuoka; Hidetoshi Kodama, both of Tokyo, Japan

[73] Assignee: Seikosha Co., Ltd., Tokyo, Japan

[21] Appl. No.: 162,888

[22] Filed: Mar. 2, 1988

[30] Foreign Application Priority Data

Mar. 3, 1987 [JP] Japan ..... 62-48285

[51] Int. Cl.[4] ..... B65H 1/26

[52] U.S. Cl. ..... 271/157; 271/164; 271/127

[58] Field of Search ..... 271/10, 126, 127, 160, 271/164, 162, 157, 22, 24

[56] References Cited

U.S. PATENT DOCUMENTS 4,307,878 12/1981 Kono ..... 271/160

4,623,137 11/1986 Irie et al. ..... 271/160

4,660,823 4/1987 Sato ..... 271/164

*Primary Examiner*—H. Grant Skaggs

*Attorney, Agent, or Firm*—Bruce L. Adams; Van C. Wilks

[57] ABSTRACT

A paper feeding device for a printer, which is constituted by a paper feeding tray and a tray receiver. The paper feeding tray has a rotatable hopper plate supported at the bottom thereof, a hopper shaft disposed at the lower surface of the front end of the hopper plate, two moving levers respectively connected to two ends of the hopper shaft, and movably supported by two sides of the paper feeding tray, guide grooves formed in the two sides in the tray fitting direction, two movable members supported by the two guide grooves, and have outwardly extending securing portions, and a spring disposed between the movable levers and the movable members, and for pushing up the hopper plate through the hopper shaft with respect to the movable lever.

A tray receiver contains two side plates disposed at a certain interval which allows the paper feeding tray to be inserted, securing grooves on the inner surfaces of the rear portion of the two side plates, and which engage with the securing portions during the mounting of the paper feeding tray, and which prevent the movement of the movable members and expands the spring to increase spring force, and a lock cam movably supported on the inner surface of the front portion of the two side plates, and which has a cam surface to which the hopper shaft can be engaged when the paper feeding tray is mounted.

1 Claim, 2 Drawing Sheets

PAPER FEEDING DEVICE FOR A PRINTER

INDUSTRIAL FIELD OF THE INVENTION

This invention relates to a paper feeding device for feeding cut sheets to a printer such as a serial dot printer, a printer for an electron photograph recorder and that for a facsimile.

PRIOR ART

A method of feeding cut sheets to a printer is generally employed in which the cut sheets are stacked in a paper feeding tray which is mounted on the printer so that the cut sheets are automatically supplied to the printer.

A tray receiver for detachably receiving the paper feeding tray is provided in the printer, and a picking roller for one at a time picking a top sheet of the cut sheets in the paper feeding tray is provided for the tray receiver. A hopper plate for pushing the stacked cut sheets up to the picking roller is provided for the paper feeding tray.

In the paper feeding tray, in order to facilitate setting the cut sheets and setting the paper feeding tray to the printer, the hopper plate is needed to be stably disposed at the bottom of the tray due to gravity when the paper feeding tray is removed from the printer. Meanwhile, when the tray is set to the printer, the hopper plate is needed to upwardly jump the stacked cut sheets by means of a spring force.

The devices of the type which meets the above requirements are known in which a manual operation lever is operated after the paper feeding tray has been set so that the hopper plate is jumped, and a device in which the hopper plate gradually moves upwardly as the paper feeding tray is inserted into the printer. However, in the former structure, it is needed to lower the hopper plate by way of re-operating the lever when the paper feeding tray is removed, therefore, operation for attaching and detaching the paper feeding tray is complicated. On the other hand, in the latter structure, the cut sheets tend to set off, causting the cut sheets to be prevented from proper feeding because the cut sheets come into contact with the picking roller during the movement of the tray when the paper feeding tray is mounted on the printer or the same is removed from the printer.

OBJECT OF THE INVENTION

An object of the present invention is to provide a paper feeding device which can be easily attached or detached without any occurrence of setting off of paper sheets when the tray is attached or detached.

MEANS TO ACHIEVE THE OBJECT

In order to achieve the above object, in this invention, the paper feeding tray and the tray receiver are constituted as follows.

The paper feeding tray is i a constituted by hopper plate which is rotatably supported at a bottom of the paper feeding tray for the purpose of stacking the cut sheets, a hopper shaft disposed on the lower surface of the front end of the hopper plate, a pair of movable levers which are connected to two ends of the hopper shaft, and which are movably supported by two sides o the paper feeding tray, guide grooves each of which is provided on the side surface of the paper feeding tray in the direction in which the tray is installed, a pair of movable members which are respectively movably supported by the corresponding two guide grooves, and in which securing portions each extending outwardly is provided, and a spring which is provided between the movable levers and the movable members, and which can apply upward urging force to said movable levers in such a manner that the same can raise the hopper plate through the hopper shaft.

The tray receiver which receives the paper feeding tray is constituted by a pair of side plates which are disposed at an interval which allows the paper feeding tray to be inserted, securing grooves which are respectively provided on inner surfaces in the rear portions of the two side plates, and which are brought into engagement with said securing portions so that the same prevent the movable member from movement and increase a spring force by way of expanding the spring, and a lock-cam which is movably supported on the inner surface in the front portion of the two side plates, and in which a cam surface to which the hopper shaft is able to be brought into engagement when the paper feeding tray is mounted.

OPERATION

When the paper feeding tray is attached to the tray receiver, the hopper shaft is brought into engagement with a cam surface of a lock-cam so that the upward movement of the hopper shaft is restricted, and when the same passes the cam surface, the above restriction is released.

When the paper feeding tray is removed from the tray receiver, the hopper shaft is forced to be lowered by means of side surfaces of the lock-cam.

BRIEF DESCRIPTION OF THE DRAWINGS

The accompanying drawings illustrate an embodiment of a paper feeding device according to the present invention, wherein.

15 . . . tray receiver
- 16 . . . side plate
- 16*a* . . . securing groove
- 26 . . . lock-cam
- 26*b* . . . cam surface
- 26*c* . . . side surface of the lock-cam

28 . . . paper feeding tray
- 28*a* . . . bottom of the tray
- 28*e* . . . side wall of the tray
- 28*f*, 28*g* . . . guide groove
- 29 . . . hopper plate
- 30 . . . hopper shaft
- 31 . . . movable lever
- 33 . . . movable member
- 33*b* . . . shaft of the movable member (securing portion)
- 34 . . . urging spring P . . . cut sheet

EMBODIMENT

Referring to the accompanying drawings, a printer paper feeding device according to an embodiment of the present invention will now be described in detail.

First, a structure of a main body of printer will now be described.

Figure 1:
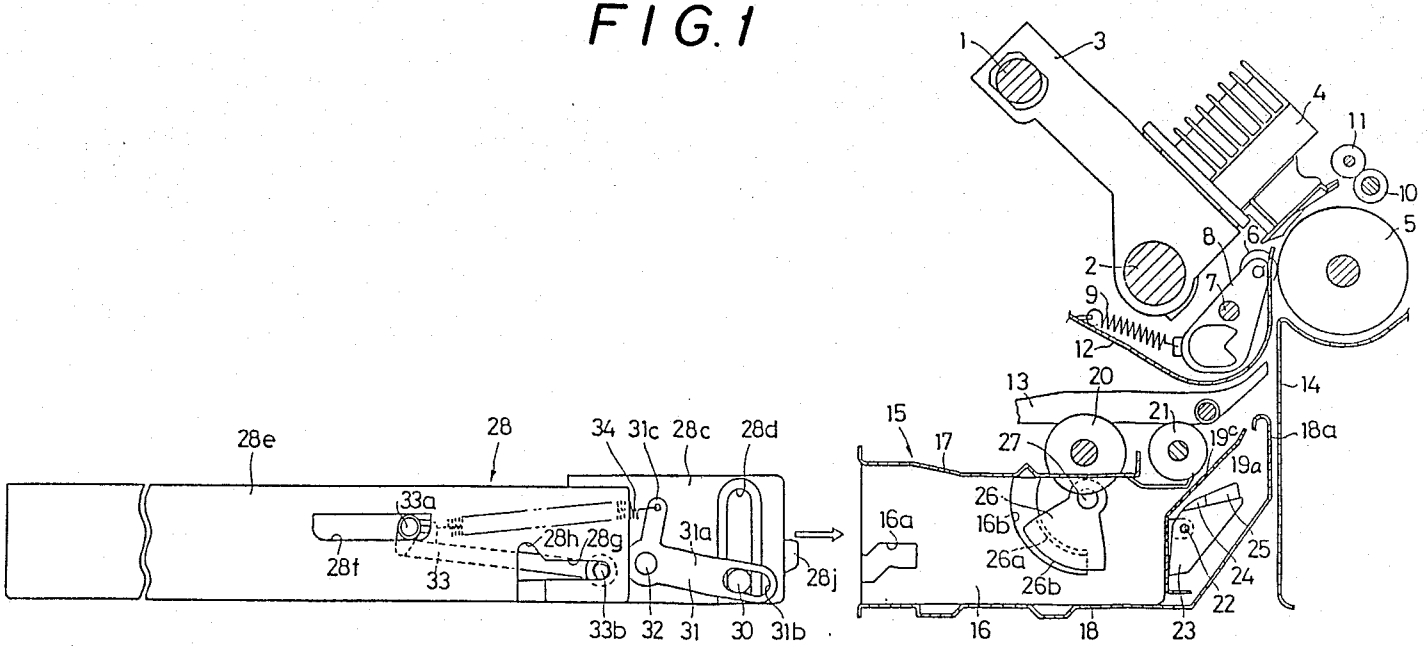
FIG. 1 is a partial right cross-sectional view showing a state in which a paper feeding tray is removed from a tray receiver.

Referring to FIG. 1, a carriage 3 is movably received by guide shafts 1 and 2 which are supported by a pair of side plates which are omitted from illustration. A printing head 4 is mounted on the carriage. In the portion at which the printing head 4 opposes, a platen 5 which is rotated by a paper feeding motor which is omitted from illustration is disposed. A friction roller 6 is positioned in contact with the platen. The friction roller 6 is supported relative to a shaft 7 by means of a movable lever 8, and is positioned in elastically contact with the platen 5 by means of a spring force of a spring 9. Above the front end of the printing head 4 is provided with a paper feeding roller 10 and a pinch roller 11 which is positioned in contact with the paper feeding roller, and which follows the movement of the same, and both of them are arranged to be driven through the aforesaid paper feeding motor in synchronization with the platen 5 when the paper is fed. Beneath the platen 5 is provided with paper guides 12, 13 and 14.

A tray receiver 15 which is disposed beneath the paper guide 13 will now be described.

In the tray receiver 15, a pair of side plates 16 (only one of them are illustrated, but substantially, the two plates are formed symmetrically) oppose each other at a predetermined interval. A space to be described hereinafter, and into which the paper feeding tray is inserted is formed by the two side-plates 16 and plates 17, 18 and 19 which are respectively disposed in the upper portion, at the bottom and in the front portion of the former. Paper guides 17*a*, 18*a* and 19*a* are integrally formed with the corresponding plates 17, 18 and 19. Reference numerals 20 and 21 represent picking rollers each of which is arranged to be driven when the cut sheets are drawn from a paper feeding tray to be described hereinafter. The lower portion of the picking roller 20 penetrates to the inside of the plate 17 over an opening which is omitted from illustration. A movable body 23 which i capable of moving relative to a shaft 22 is provided behind the plate 19. The upper surface of the movable body 23 is, in a fixed manner, provided with plastic guides 24 with a smooth upper surface and load members 25 made of a material having a great friction coefficient such as rubber. Two pairs of the guide bodies 24 and the load members 25 are disposed as to be disposed at a predetermined spacing when viewed from side. A picking roller 21 is disposed at the intermediate position between the pairs.

In each inner surface of the rear portions of the side plates 16 is provided with a securing groove 16*a*. A sector lock-cam 26 is rotatably fitted relative to a shaft 27 on the inside of the front portion fromed by the side plates 16. The lock-cam 26 is usually hung as illustrated due to its dead weight. A projection 26*a* is projectingly formed over the outer surface of the lock-cam 26. This projection is engaged with a groove 16*b* provided in the inner surface of the side plate 16. As a result of this engagement, the movement of the lock-cam 26 in the tray inserting direction, that is, in the right direction, is restricted, while the movement in the inverse direction, that is, in the tray removing direction is allowed. However, this restriction can be also realized by another structure, for example, in which a pin or a projection which abuts against the right side-surface of the lock-cam 26 is projectingly formed on the inner surface of the side plate 16.

Figure 2:
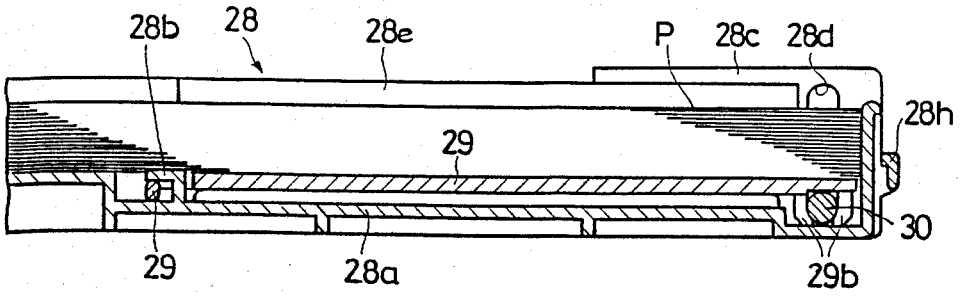
FIG. 2 is a vertical cross-sectional view of a paper feeding tray.

A paper feeding tray 28 which is attached to and detached from the tray receiver 15 will now be described with reference to FIGS. 1 and 2.

The paper feeding tray 28 is formed in such a manner that the front surface thereof is opened, and is formed in substantially a box shape, whereby cut sheets P can be accommodated therein. A hopper plate 29 for receiving the accommodated cut sheets P is disposed at the bottom 28*a* of the tray 28. An end portion 29*a* of the hopper plate 29 is rotatably and slidably supported by a receiver 28*b*. A hopper shaft 30 is positioned in contact with the lower surface of the front portion of the hopper plate 29. The hopper shaft 30 is, in this embodiment, held by claws 29*b* which are vertically form from the lower surface of the front end of the hopper plate 29. The two ends of the hopper shaft 30 project over the side surfaces 28*c* of the tray after penetrating the corresponding through holes 28*d* formed in the side walls 28*c* of the tray. A moving lever 31 is respectively movably supported relative to a shaft 32 on the outer surface of the side wall 28*c* of the tray. The two ends of the hopper shaft 30 are engaged with the corresponding through holes 31*b* in the arms 31*a* of the movable levers 31. Shafts 33*a* and 33*b* of movable members 33 are movably engaged with guide grooves 28*f* and 28*g* formed in the side walls 28*e* of the tray in the tray inserting direction. The shaft 33*b* projects by a predetermined length over the outer surfaces of the side walls 28*e*, and the same is capable of engaging with the securing grooves 16*a* formed in the corresponding side plates 16 of the tray receiver 15. Between the arms 31*c* of the movable levers 31 and the movable members 33 is provided with an urging spring 34. Since the movable members 33 have been shifted at the right portion in FIG. 1 in a state where the paper feeding tray 28 is drawn from the tray receiver 15, the urging spring 34 is not expanded, therefore any rotational force is not applied to the movable levers 31. Therefore, the hopper plate 29 is due to its dead weight positioned at the bottom 28*a* as shown in FIG. 2. The hopper plate 29 is also disposed at the bottom 28*a* due to its dead weight when there is no cut sheet P.

The operation of inserting the paper feeding tray 28 into the tray receiver 15 will now be described.

The paper feeding tray 28 in which the cut sheets P have been stacked is pushed to the right portion of the tray receiver 15 as shown in FIG. 1. When the shaft 33*b* of the movable members 33 is positioned at the entrance of the securing grooves 16*a* in the said plates 16 of the tray receiver 15, the hopper shaft 30 is positioned at A shown in FIG. 3. Meanwhile, when the shaft 33*b* of the movable members 33 is brought into contact with the slanted surfaces of the lower portions of the securing grooves 16*a*, the hopper shaft 30 is positioned at B shown in FIG. 3. The paper feeding tray 28 is further inserted, however, the same is prevented from movement when the shaft 33*b* of the movable member 33 is brought into contact with the slanted surface of the securing groove 16*a*. Therefore, the movement of the movable members 33 is prevented, while the movable levers 31 further advanced with the paper feeding tray 28. As a result of this, the urging spring 34 is expanded as the paper feeding tray 28 is inserted to the right portion, whereby the spring force thereof is increased.

Consequently, a counterclockwise rotational force is applied to the movable levers 31, and the hopper shaft 30 is pushed upwardly. However, the hopper shaft 30 is slightly pushed upwardly in this state, and is brought into contact with the cam surface 26*b* of the lock-cam 26, is then moved from point C shown in FIG. 3 to point D shown in FIG. 3 along the cam surface 26*b*. That is, the spring 34 charges a sufficient spring force as the paper feeding tray 28 is pushed in, but the hopper shaft 30 is restricted in such a manner that the same is substantially moved horizontally by means of the cam surface 26*b* of the lock-cam 26.

Figure 3:
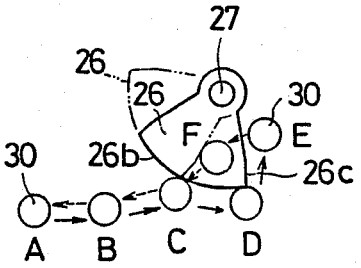
FIG. 3 illustrates the relationship between a lock-cam and a hopper shaft.
Figure 4:
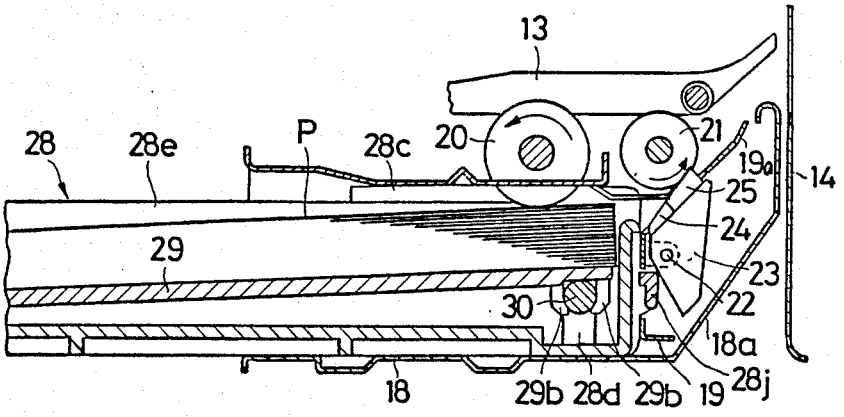
FIG. 4 is a cross-sectional view illustrating a state in which a paper feeding tray is connected to a tray receiver.

When the paper feeding tray 28 is inserted into the tray receiver 15 until it reaches a predetermined position, the hopper shaft 30 passes over the cam surface 26*b* of the lock-cam 26. As a result of this, the hopper shaft 30 is rapidly moved upwardly with its restriction released (see E shown in FIG. 3). Consequently, as shown in FIG. 4, the hopper plate 29 is rotated counterclockwise so that the top sheet P is abutted against the picking roller 20. That is, the cut sheets P are abutted against the picking roller 20 only when the paper feeding tray 28 is inserted by a predetermined depth. In this state, a projection 28*j* which is projectingly formed on the front surface of the paper feeding tray 8 projects over the through hole 19*b* (see FIG. 1) so that the movable body 23 is displaced from the position shown in FIG. 1 to that shown in FIG. 4. As a result of this, the pair consisting of the guide 24 and the load member 25 projects over the through hole 19*c* in the paper guide 19*a*. When a recess 28*h* in the rear portion of the guide groove 28*g* shown in FIG. 1 is shifted to the position at which the same opposes the slanted surface of the securing groove 16*a*, the shafts 33*a* and 33*b* of the movable members 33 have been shifted to the left end of the guide grooves 28*f* and 28*g*. Especially, the upward movement of the shaft 33*b* is allowed by means of the recess 28*h*, thereby the shaft 33*b* advances to the position at which the same is abutted against the left end surface of the securing groove 16*a*. As a result of this, coming off of the paper feeding tray 28 is restricted.

In the state shown in FIG. 4, when the picking rollers 20 and 21 are rotated in the direction designated by an arrow, the top sheet P is fed. In this state, the simultaneous feeding of two or three sheets is prevented by means of the load members 25, whereby only the top sheet is fed. The cut sheet P is introduced in front of the printing head 4 through the platen 5 and the friction roller 6, and is printed in a predetermined manner by means of the printing head 4, and is then picked up through the paper feeding roller 10 and the pinch roller 11.

The operation of removing the paper feeding tray 28 from the tray receiver 15 will now be described.

In a case where the cut sheet P remains in the paper feeding tray 28 when the paper feeding tray 28 is removed from the tray receiver 15, the cut sheets P are abutted against the picking roller 20, and several sheets are fed adjacent to the picking roller 21. When the paper feeding tray 28 is removed to the left in this state, the projection 28*j* in the front surface of the tray is reversed, and the movable body 23 is due to its dead weight restored to the state shown in FIG. 1. Simultaneously, the hopper shaft 30 is moved left. As shown in FIG. 3, since the hopper shaft 30 is positioned at right of the side surface 26*c* of the lock-cam 26, the hopper shaft 30 is brought into engagement with the side surface 26*c* of the lock-cam 26, whereby the side surface 26*c* is moved. The movement of the lock-cam 26 is allowed until the same is brought into contact with the plate 17 (position shown by long- and dash-line) which is disposed on the upper surface, and further movement is prevented. Therefore, the hopper shaft 30 is rapidly dropped along the side surface 26*c* of the lock-cam 26 (from point F to C shown in FIG. 3) As result of this, since the cut sheet P on the hopper plate 29 is moved away from the picking roler 20, top several sheets (which have been slightly projected toward right over the paper feeding tray 28) are prevented from being left in the tray receiver 15. When the hopper shaft 30 is moved rearwardly to the position B shown in FIG. 3, the urging spring 30 is shrunk as in the original state, therefore, the hopper plate 29 has been disposed at the bottom 28*a* of the tray 28. As a result of this, the paper feeding tray 28 is completely removed from the tray receiver 15 as shown in FIG. 1.

In the embodiment described above, the movable members 33 can be disposed on the outer surfaces of the side surfaces 28*e*, while the movable levers 31 may be disposed on the inner surfaces of the side walls 28*c*. That is, it is a simple matter in design that whether the movable levers 31 and the movable members 33 are disposed on either one of the side wall 28*c* or 28*e*.

Furthermore, the structure for connection of the movable levers 31 and the hopper plate 30 is not limited to the above description. Namely, the hopper plate 30 may be fixed for connection to the arms 31*a* of the movable levers 31. In this case, the through holes 28*d* may be formed in a concentric circle relative to the shaft 32. Furthermore, if the movable levers 31 are disposed on the inner surfaces of the side walls, the hopper plate 30 is not needed to penetrate the side walls of the tray, therefore, the through holes 28*d*, also, and of course, become needless.

EFFECT OF THE INVENTION

As described above, in the paper feeding device according to the present invention, the paper feeding tray can be attached to and detached from the tray receiver only by pushing in or pulling out, therefore, any manual operation in the conventional device becomes needless. As a result of this, attaching and detaching of the paper feeding tray is facilitated. Furthermore, when the tray is attached or detached, no paper setting off which occurs at setting the tray occurs, therefore, a proper paper feeding can be maintained, and stable feeding of the paper to the printer can be realized.

What is claimed is:

1. A paper feeding device for a printer comprising: a paper feeding tray in which cut sheets are stored, and a tray receiver which detachably receives said paper feeding tray, said paper feeding tray being constituted by a hopper plate which is rotatably supported at a bottom of said paper feeding tray for the purpose of stacking said cut sheets, a hopper shaft disposed on the lower surface of the front end of said hopper plate, a pair of movable levers which are connected to two ends of said hopper shaft, and which are movably supported by two sides of said paper feeding tray, guide grooves each of which is provided on the side surface of said paper feeding tray in the direction in which the tray is installed, a pair of movable members which are respectively movably supported by the corresponding two guide grooves, and in which securing portions each extending outwardly is provided, and a spring which is provided between said movable levers and said movable members, and which can apply upward urging force to said movable levers in such a manner that the same can rise said hopper plate through said hopper shaft, while said tray receiver being constituted by a pair of side plates which are disposed at an interval which allows said paper feeding tray to be inserted, securing grooves which are respectively provided on inner surfaces in the rear portions of said two side plates, and which are brought into engagement with said securing portions so that the same prevent said movable member from movement and increase a spring force by way of expanding said spring, and a lock-cam which is movably supported on the inner surface in the front portion of said two side plates, and in which a cam surface to which said hopper shaft is able to be brought into engagement when said paper feeding tray is mounted.

* * * * *